US006179712B1

(12) United States Patent
Sugimoto

(10) Patent No.: US 6,179,712 B1
(45) Date of Patent: Jan. 30, 2001

(54) GAME MACHINE HAVING SPEAKER

(75) Inventor: Kiyoshi Sugimoto, Tokyo (JP)

(73) Assignee: Universal Sales Co., Ltd., Tokyo (JP)

( * ) Notice: Under 35 U.S.C. 154(b), the term of this patent shall be extended for 0 days.

(21) Appl. No.: 09/120,279

(22) Filed: Jul. 22, 1998

(30) Foreign Application Priority Data

Jul. 23, 1997 (JP) ..... 9-212642

(51) Int. Cl.[7] ..... A63F 9/24

(52) U.S. Cl. ..... 463/35; 463/16; 463/20; 273/143 R; 273/121 B

(58) Field of Search ..... 463/35, 20; 273/121 B

(56) References Cited

U.S. PATENT DOCUMENTS

| | | | | |
|---|---|---|---|---|
| 3,822,004 | | 7/1974 | Bolen . | |
| 4,081,631 | | 3/1978 | Feder . | |
| 4,334,679 | | 6/1982 | Doyle et al. . | |
| 5,697,611 | | 12/1997 | Kelly et al. . | |
| 5,803,451 | * | 9/1998 | Kelly et al. | 273/118 R |
| 5,989,121 | * | 11/1999 | Sakamoto | 463/20 |

FOREIGN PATENT DOCUMENTS

| | | | | |
|---|---|---|---|---|
| 6023098 | * | 2/1994 | (JP) | A63F/7/02 |
| 8-322983 | | 12/1996 | (JP) . | |

OTHER PUBLICATIONS

Patent Abstracts Of Japan vol. 097, No. 004, Apr. 30, 1997 & JP 08 322983 A (NEWGIN KK), Dec. 10, 1996.

* cited by examiner

*Primary Examiner*—Michael O'Neill
*Assistant Examiner*—Julie Kasick
(74) *Attorney, Agent, or Firm*—Pillsbury Madison & Sutro LLP

(57) ABSTRACT

A game machine having a speaker whose sound transmitting holes are not exposed to the front side of the game machine so that the speaker is protected from a wire-shaped object, which would otherwise be inserted through the sound transmitting holes, destroying the speaker. A speaker 22 is installed on the wall of a cancel shoot 21 that is installed near a pay-out hole 12 through which medals are paid out to the player, so that the speaker 22 will not be exposed to the pay-out hole 12. Specifically, the speaker 22 is installed at a position that is displaced from the immediate back of the pay-out hole 12. In addition, the sound transmitting unit of the speaker 22 is attached on the wall of the box-shaped cancel shoot 21 toward the interior of the box-shaped cancel shoot 21. As a result, effect sounds generated by the speaker 22 propagate through the interior space of the box-shaped cancel shoot 21, and are transmitted outside of the game machine via the pay-out hole 12. Thus, the speaker 22 is hidden inside the game machine 22, and the effect sounds generated by the speaker 22 are transmitted from the pay-out hole without being confined inside the game machine 22.

2 Claims, 4 Drawing Sheets

GAME MACHINE HAVING SPEAKER

This patent application claims priority based on the Japanese patent application, H09-212642, filed on Jul. 23, 1997, the contents of which are incorporated herein by reference.

BACKGROUND OF THE INVENTION

1. Field of the Invention

The present invention relates to a game machine having a speaker for generating effect sounds in response to the state of the game. In particular, the present invention relates to a game machine in which the speaker is installed in a characteristic configuration.

2. Description of Related Art

In general, pin-ball machines such as pachinko machines and game machines such as slot machines generate various effect sounds corresponding to the state of the game. For example, a pachinko machine generates effect sounds when a ball hits a prize hole and causes a movable prize entry gate (attacker) to open. In addition, a slot machine generates effect sounds when a player hits a prize such as a big bonus game, which occurs when the combination of symbols shown on the rotation reel of the slot machine matches a prize combination. These effect sounds inform a player that the player is about to receive game mediums, enhancing the excitement of the player and satisfying the player's interest for the game to a greater degree.

These game machines are equipped with a speaker for generating the above-explained effect sounds. In the conventional game machines, a speaker is installed behind the front cover of the game machine that faces the player. The sound transmitting holes of the speaker are exposed on the front cover of the game machine so as to transmit the effect sounds directly to the player. For example, in a pachinko machine having an upper pan for receiving game balls to be given to the player as the prize balls, the speaker is installed near the pan. In a slot machine, a speaker is installed near a medal receiving pan for receiving pay-out medals.

FIG. 1 shows a standard slot machine 1 that is equipped with an effect sound generating speaker. The slot machine 1 has a speaker, a cabinet 2 inside of which a rotation reel unit, a hopper, and the like are installed, a front door 3 having a set of multiple windows 5, the windows being installed in the front portion of the cabinet 2 so that the front door 3 can be freely opened or closed, a rotation reel 4, a pay-out hole 6, a medal receiving pan 7, an ashtray 8, and a speaker cover 9 having sound transmitting holes 9*a*. Multiple symbols not shown in the drawing are depicted on the surface of the rotation reel 4, which can be seen through each of the multiple windows 5. When multiple symbols appear on the set of multiple windows 5 in a combination that matches a prize combination during the game, a prescribed number of medals are produced from the pay-out hole 6 into the medal receiving pan 7. The ashtray 8 is installed on the left side of the medal receiving pan 7. The speaker, which generates effect sounds, is attached to the reverse side of the speaker cover 9 on the front door 3. The speaker cover 9 has many small holes which constitute the sound transmitting holes 9*a*.

However, the sound transmitting holes 9*a* are exposed on the front portion of the game machine. Therefore, when a malicious player inserts for a prank a wire-shaped object into the sound transmitting holes, the diaphragm of the internal speaker and the like can be damaged. Moreover, when the wire-shaped object penetrates through the diaphragm of the internal speaker and the like, parts installed inside the cabinet such as a hopper and the like can also be damaged.

In addition, since various parts are installed on the back of the front portion of the conventional game machine, the remaining space on the back of the front portion of the game machine is not large enough to accommodate a speaker having a large diameter. Therefore, a speaker having a relatively small diameter is installed on the back of the front portion of the conventional game machine. Such a small speaker cannot generate sounds with a large volume. In addition, such a small speaker cannot produce low frequency sounds in sufficiently a large volume. Hence, when a game machine having a conventional speaker is installed in a game hall where there is an excessive amount of noise, the conventional speaker cannot produce effect sounds in a volume that is large enough to fully reach the player. Therefore, some of the effect sounds generated by the conventional speaker cannot fully satisfy the player's interest for the game.

SUMMARY OF THE INVENTION

Given these circumstances, it is an object of the present invention to provide a game machine having a speaker for generating effect sounds in response to the state of the game such that the speaker is installed in the interior of the game machine near the pay-out hole, from which game mediums are paid out to the player, so that the speaker is not exposed on the front portion of the game machine.

When this configuration is adopted, the speaker is hidden inside the game machine. In addition, the effect sounds generated by the speaker are transmitted via the pay-out hole without being confined inside the game machine. Therefore, the speaker is protected against a possible prank of the player, and the effect sounds generated by the speaker are transmitted to the player without deteriorating. As a result, the speaker becomes protected from an object that would otherwise be inserted into the speaker, maintaining its sound transmitting performance.

In addition, a game machine according to the present invention has a first speaker, which is installed on the back of the front cover of the game machine that faces the player, and a second speaker, which is installed in the interior of the game machine near the pay-out hole, from which game mediums are paid out to the player, so that the speaker is not exposed on the front portion of the game machine.

According to this configuration, the second speaker provides an additional volume of effect sounds, compensating for the insufficient volume of effect sounds generated by the first speaker.

In addition, since the interior part of the game machine in which the second speaker is installed is large enough to accommodate a speaker having a large diameter, the diameter of the second speaker can be made large. Thus, the second speaker will compensate for the deficiency in the volume of low frequency effect sounds generated by the first speaker. In this way, powerful effect sounds can be transmitted to the player so as to fully satisfy the player's interest for the game.

DETAILED DESCRIPTION OF THE INVENTION

Next, an embodiment of the present invention will be explained with reference to the attached drawings. In this embodiment, the present invention is applied to a slot machine.

Figure 2:
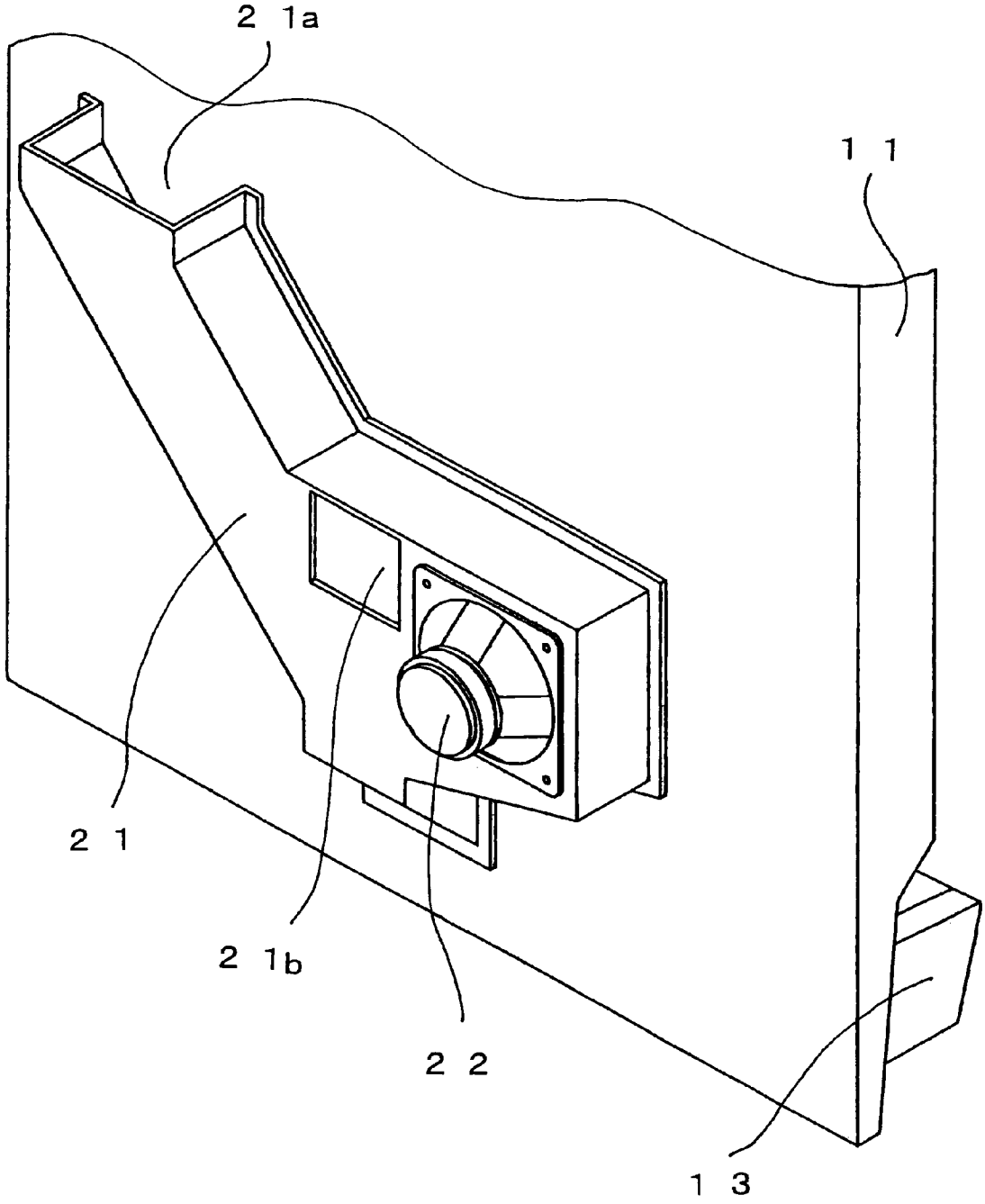
FIG. 2 is an oblique view of the back of a front door that constitutes a game machine according to an embodiment of the present invention.
Figure 3:
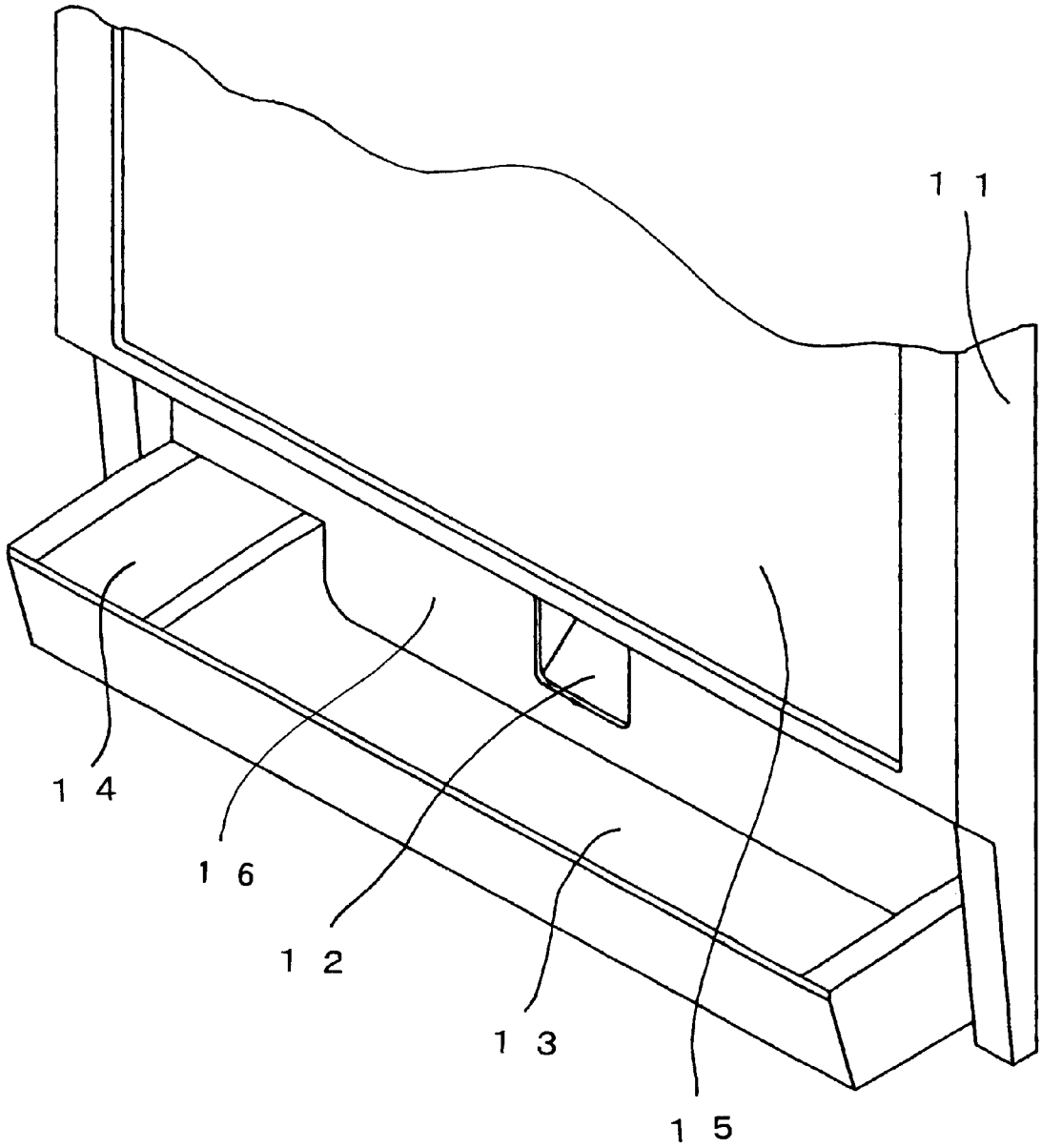
FIG. 3 is an oblique view of the front side of the front door of the game machine according to the present embodiment.

FIG. 2 is an oblique view of a portion of the back of a front door 11 that constitutes a slot machine according to the present embodiment. FIG. 3 is an oblique view of a portion of the front side of this front door 11.

As shown in FIG. 3, the front side of the front door 11 has a pay-out portion 16 including a pay-out hole 12 through which medals are supplied to the player, a medal receiving pan 13 which receives and holds the medals supplied to the player through the pay-out hole 12, an ashtray 14 into which the player can dispose of cigarette ash and cigarette butts, and a midsection panel 15 that is installed above the medal receiving pan 13. Characters of the slot machine or the like not shown in the drawing are depicted on the midsection panel 15. Like the slot machine 1 shown in FIG. 1, this front door 11, which can be freely opened or closed, is installed in the front portion of a cabinet containing a rotation reel unit, a hopper, and the like.

As shown in FIG. 2, a cancel shoot 21 is attached on the back of the front door 11. This cancel shoot 21 constitutes a game medium transport path for guiding medals to the pay-out hole 12, where the medals are game mediums. When a selector not shown in the drawing, which is installed inside the cabinet, detects that a fake medal has been put into a medal input port, the fake medal is guided to the cancel shoot 21 via a first opening 21*a*, and is sent down to the medal receiving pan 13 via the pay-out hole 12. Medals which are given to the player when the player wins a prize are guided from a hopper not shown in the drawing that is installed inside the slot machine to the cancel shoot 21 via a second opening 21*b*, and are paid out to the player via the pay-out hole 12.

A speaker 22 is installed near the pay-out hole 12 on the wall of the cancel shoot 21. At this position inside the slot machine, the speaker 22 is not reachable from the pay-out hole 12.

Figure 4A:
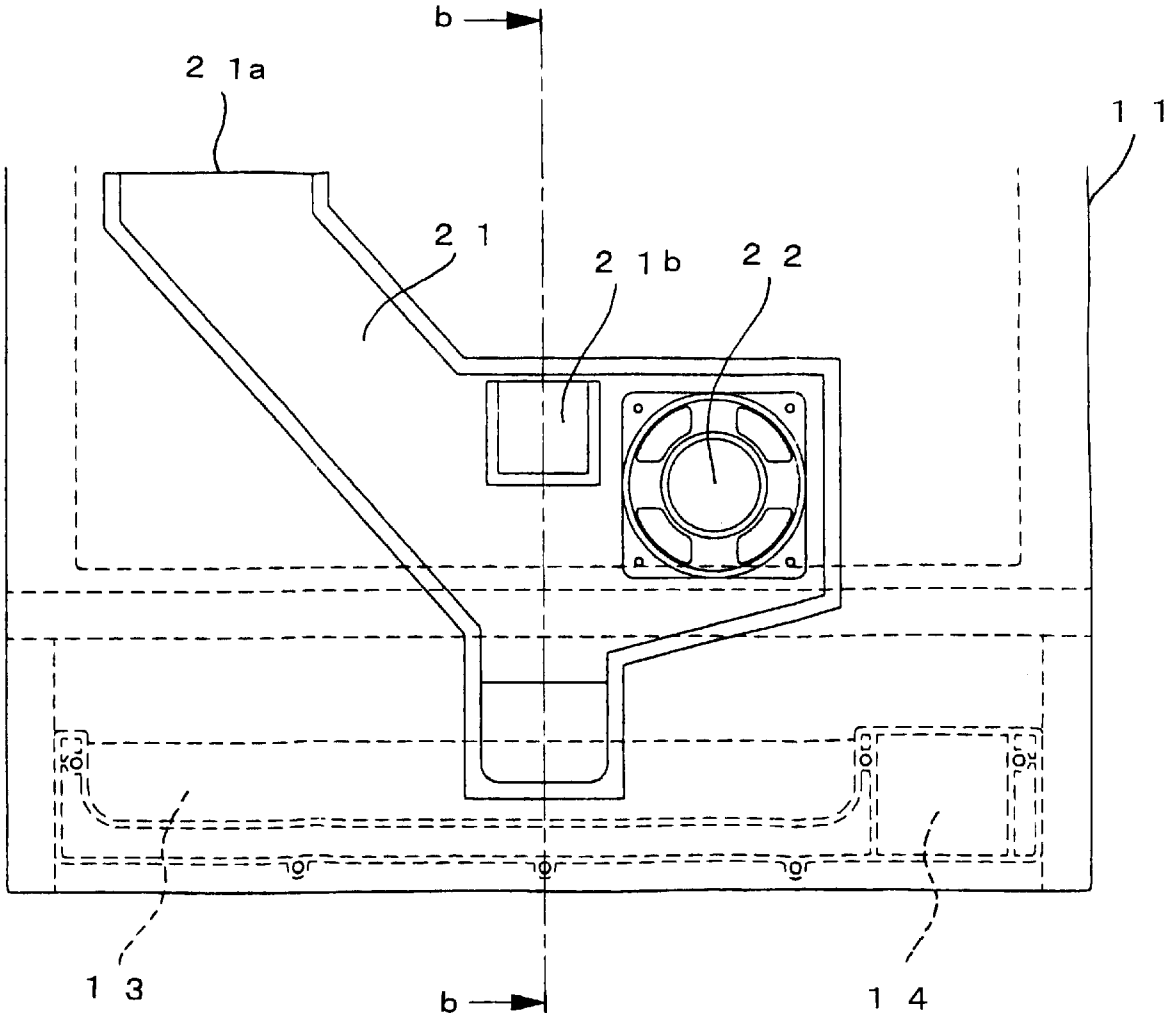
FIG. 4A shows the back of the front door of the game machine according to the present embodiment.
Figure 4B:
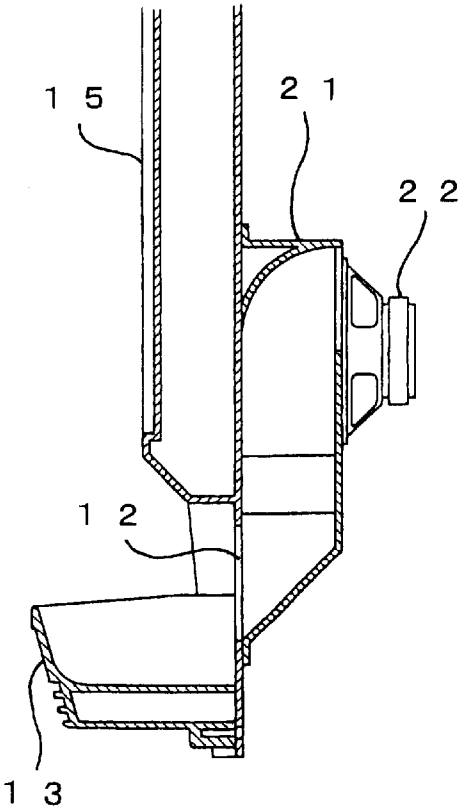
FIG. 4B shows a vertical cross section of the front door of the game machine according to the present embodiment.

As shown in FIGS. 4A and 4B, the speaker 22 is not installed directly behind the pay-out hole 12. The installment position of the speaker 22 is displaced from the immediate back of the pay-out hole 12. Specifically, the speaker 22 is shielded from the pay-out hole 12 by the wall of the cancel shoot 21. Here, FIG. 4A is a back-view of the front door 11, and FIG. 4B is a cross section of what is shown in FIG. 4A across the plane containing the line b—b and is perpendicular to the front door 11. In FIGS. 4A and 4B, the same reference codes are used for components that correspond to those used in FIGS. 2 and 3.

The speaker 22 is attached on the wall of the boxshaped cancel shoot 21 so that the sound transmission unit of the speaker 22 will be directed toward the interior of the box-shaped cancel shoot 21. Therefore, the effect sounds generated by the speaker 22 propagate the space inside the box-shaped cancel shoot 21, and are emitted outside of the slot machine via the pay-out hole 12.

In the slot machine according to the present embodiment, which is structured in the above-described manner, the speaker 22 is hidden inside the slot machine, and the effect sounds generated by the speaker 22 are transmitted from the pay-out hole 12 without being confined inside the slot machine. As a result, the speaker 22 is protected against a possible prank of the player, and the effect sounds generated by the speaker 22 are transmitted to the player without deteriorating.

Therefore, unlike the case of the conventional slot machine, according to the present embodiment, the speaker 22 and the parts installed inside the cabinet are protected from an object that would otherwise be inserted from outside into the speaker by a malicious player.

Figure 1:
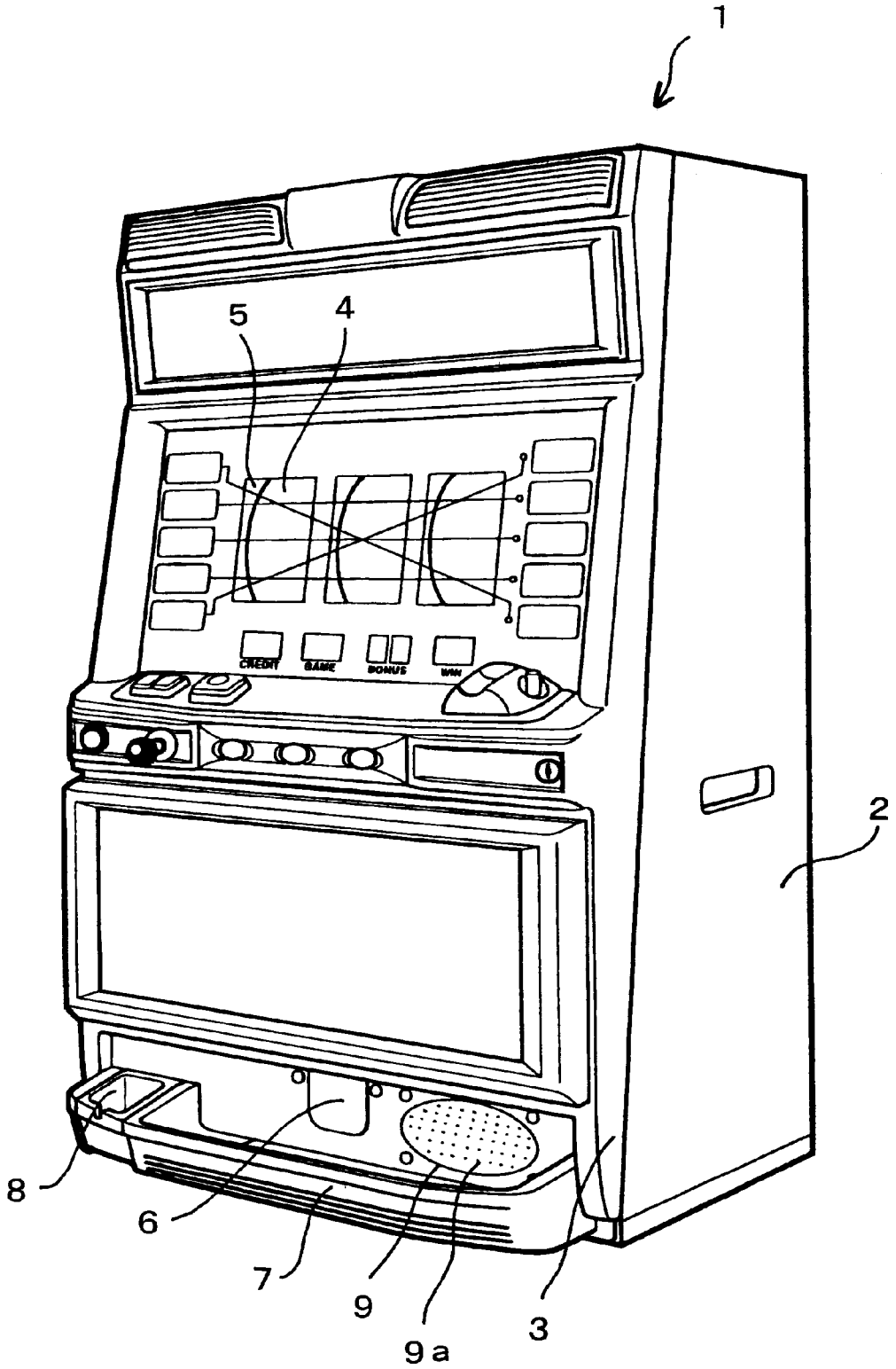
FIG. 1 is an oblique view of a standard slot machine.

In addition, in the standard slot machine 1 shown in FIG. 1, two speakers can be installed in the slot machine 1 by installing an additional above-explained speaker 22 on the wall of the cancel shoot that is installed on the back of the front door 3.

In other words, a first speaker, which is a conventional speaker, is installed on the wall that constitutes a portion of the medal receiving pan 7. The sound transmitting holes 9a of the first speaker are formed on the front cover of the slot machine facing the player. A second speaker, as the above-explained speaker 22, is installed on the wall of the cancel shoot.

According to this configuration, the second speaker 22 provides an additional volume of effect sounds, compensating for the insufficient volume of effect sounds generated by the first speaker. As a result, even if the slot machine is located inside a noisy hall, the effect sounds can be fully transmitted to the player in response to the state of the game.

In addition, since the interior part of the game machine, in which the second speaker 22 is to be installed, is large enough to accommodate a speaker having a large diameter, the diameter of the second speaker 22 can be made larger than the diameter of the first speaker. Accordingly, the second speaker 22 compensates for the insufficient volume of the low frequency sound output that is generated by the first speaker.

Therefore, according to this configuration, the first speaker, which is installed on the front cover of the slot machine, transmits the high frequency portion of the effect sounds directly to the player, and the second speaker 22, which is installed inside the slot machine, transmits the low frequency portion of the effect sounds to the player via the pay-out hole 6. As a result, the second speaker 22 compensates for the insufficient volume of the low frequency sound output and the insufficient absolute volume of the effect sounds, which are generated by the first speaker, achieving improved sound effects of the first and second speakers. Thus, even if this slot machine is located inside a noisy hall, effect sounds can be fully transmitted to the player, enabling the player to be immersed in the game.

In the above-discussed embodiment, the present invention is applied to a slot machine. However, it should be noted that the present invention can also be applied to a pin-ball machine such as a pachinko machine having a pay-out hole of an upper pan for accumulating game balls, a pay-out hole of a lower pan for accumulating game balls, and a game ball transport path. In this case, as in the case of the present invention, a speaker can be installed inside the machine where the speaker is not exposed to the pay-out hole, for example, at a position on the wall of the game ball transport path, such that the position is displaced from the immediate back of the pay-out hole, near the upper pan or the lower pan. At such a position, the speaker is shielded from the pay-out hole. In this way, the same effects can be achieved as in the above-discussed embodiment.

In this case, in addition, a first speaker is installed on the back of the front side of the machine, the front side of the machine constituting a portion of the wall of the lower pan. A second speaker 22 is installed at a position on the wall of the game ball transport path, such that the position is displaced from the immediate back of the pay-out hole. In this way, the second speaker 22 compensates for the insufficient volume of the low frequency sound output and the insufficient absolute volume of the effect sounds generated by the first speaker.

Although the present invention has been explained in reference to the embodiments, it is apparent for those skilled in the art that many changes and modifications can be made without departing from the spirit and scope of the invention, as clear from the following claims.

What is claimed is:

1. A game machine comprising:

a pay-out portion having a pay-out hole through which the game machine pays out game mediums to a player;

a pan for accumulating the game mediums which are paid out to the player;

a box-shaped cancel shoot having a wall through which the game mediums are transported to the pay-out hole;

a first speaker for generating sound effects in response to a state of a game, which is installed on a back side of a wall that constitutes a portion of the pan and a front cover of the game machine, the front cover facing the player; and a second speaker for generating and transmitting additional sound effects through the box-shaped cancel shoot in response to the state of the game, which is installed at a position on the wall of the box-shaped cancel shoot, the position being inside the game machine near the pay-out hole and being displaced from a position that is directly behind the pay-out hole, without being exposed to the pay-out hole.

2. A game machine as claimed in claim 1, wherein the medium game machine is a slot machine.

* * * * *